US005357916A

United States Patent [19]

Matterazzo

[11] Patent Number: 5,357,916

[45] Date of Patent: Oct. 25, 1994

[54] VALVE ADJUSTER MECHANISM FOR AN INTERNAL COMBUSTION ENGINE

[75] Inventor: John P. Matterazzo, Madison Heights, Mich.

[73] Assignee: Chrysler Corporation, Highland Park, Mich.

[21] Appl. No.: 200,500

[22] Filed: Dec. 27, 1993

[51] Int. Cl.[5] ..... F01L 1/34

[52] U.S. Cl. ..... 123/90.16; 123/90.43

[58] Field of Search ..... 123/90.15, 90.16, 90.27, 123/90.39, 90.41, 90.43, 90.44, 90.46, 198 F

[56] References Cited

U.S. PATENT DOCUMENTS

| | | | |
|---|---|---|---|
| 4,188,933 | 2/1980 | Iizuka | 123/198 F |
| 4,475,489 | 10/1984 | Honda | 123/90.16 |
| 4,546,734 | 10/1985 | Kodama | 123/90.16 |
| 4,638,773 | 1/1987 | Bonvallet | 123/90.16 |
| 5,018,487 | 5/1991 | Shinkai . | |
| 5,025,761 | 6/1991 | Chen | 123/90.16 |
| 5,033,420 | 7/1991 | Matayoshi et al. | 123/90.16 |
| 5,113,813 | 5/1992 | Rosa | 123/90.16 |
| 5,148,783 | 9/1992 | Shinkai et al. | 123/90.16 |

*Primary Examiner*—E. Rollins Cross
*Assistant Examiner*—Weilun Lo
*Attorney, Agent, or Firm*—Kenneth H. MacLean

[57] ABSTRACT

A valve control apparatus and control for one of two intake valves in an overhead camshaft type engine having end pivoted rocker arms and combustion chambers each with two intake valves. The engine's cylinder head has a bore extending beneath the intake valve lash adjusters and has a shaft rotatable in the bore whereby in a first position the shaft supports all of the lash adjusters and in a second position, shaft eccentrics allow movement of the abutting lash adjusters so that the associated valve will not be activated. Consequently, the combustion chambers of the engine can operate with two functional intake valves or alternately with one functional intake valve and one non-functional intake valve.

9 Claims, 2 Drawing Sheets

VALVE ADJUSTER MECHANISM FOR AN INTERNAL COMBUSTION ENGINE

BACKGROUND OF THE INVENTION

1. Field of the Invention

This concerns apparatus to regulate valve train operation of an internal combustion engine of the type with more than one intake valves per cylinder whereby only one of the intake valves is activated during low speed/-low load operation of the engine for better fuel economy and more complete combustion. During operation of the engine under higher speed and greater load conditions, both valves are activated for greater response and power.

2. Description of Related Art

The subject valve regulating apparatus controls the operation of the engine valve train to increase engine efficiency and flexibility. It is specifically directed to a multi-valve type engine with at least two intake valves per cylinder. The apparatus activates only one intake valve during idle and low speed operative conditions to improve fuel economy and promote complete combustion of fuel. However during higher speed, higher load engine operation when better breathing and resultantly more power is called for, both intake valves are activated.

The subject apparatus provides a rotatable shaft with internal eccentric portions so that in one angular position the shaft supports all the lash adjuster of the engine. In a second angular position 180 degrees from the first, the eccentrics allow one lash adjuster for each combustion chamber to move downward and withdraw the associated rocker arm from interaction with the camshaft. Incorporation of this mechanism in an engine is relatively simple and does not require expensive modifications to cylinder head design. The mechanism is also easy to assemble and calibrate. It is simple, extremely reliable, and relatively cheap.

Others have attempted to provide valve regulation by mechanisms. One previous attempt to provide a selective deactivation of support by a lash adjuster is disclosed in U.S. Pat. No. 4,546,734 to Kodama. Kodama utilizes a pivotal cam member actuated by a solenoid actuator to open a bleed valve formed in the bottom of the hydraulic lash adjuster. Bleeding the lash adjuster causes it to collapse and withdraw the rocker arm from interaction with the camshaft.

Several other patents disclose mechanisms to deactivate or modify valve operation. For example, the mechanism disclosed in U.S. Pat. No. 3,413,965 to Gavasso uses a first camshaft to conventionally operate the valves and adds a second camshaft to establish the position of a pivotal adjustment member which is positioned between the second camshaft and the rocker arm. Similar dual camshaft systems are disclosed in U.S. Pat. Nos. 4,638,773 and 4,724,822 in which addition hydraulic mechanisms are added. The mechanism disclosed in U.S. Pat. No. 4,475,489 to Honda uses first and second camshafts each of which engage the rocker arm. The non-overhead cam type engine disclosed in the U.S. Pat. No. 4,414,935 to Curtis uses a rotatable slotted sleeve as a selectively adjustable pivot for a valve rocker arm in addition to the usual lash adjuster.

It is also known to use selectively controlled hydraulically actuators or mechanisms to move a support for a rocker arm as seen in U.S. Pat. Nos. 4,167,931; 4,188,933; and 4,462,353.

SUMMARY OF THE INVENTION

The subject apparatus regulates operation of an engine's valve train to provide increased engine flexibility and is specifically directed to use for an engine with multiple intake valves per cylinder. The apparatus activates only one intake valve during idle and low speed operative conditions to improve fuel economy and promote complete combustion of fuel. However during higher speed, higher load engine operation when better breathing and resultantly more power is called for, both intake valves are activated. The subject apparatus is a low cost and extremely reliable means to achieve the valve regulation.

Therefore, an advantage and object of this improved valve regulator is to provide a simple mechanism which operates on all the intake valves simultaneously and effects each valve equally without complicated calibration of the device.

Another advantage and object of this valve regulator is to provide an easily installed mechanism in the engine which works with existing valve train components.

Still further advantages and objects of the subject valve regulator will be more apparent by reference to the following detailed description of an embodiment, reference being made to the drawings thereof as described hereafter.

IN THE DRAWINGS

FIG. 1 is a cross-sectional elevational end view of an engine cylinder head with the subject valve control device for one of the two intake valve in an activating operative position; and FIG. 2 is a cross-sectional elevational end view of the engine cylinder head with the subject valve control device for the one intake valve in an alternate inactivating operative position; and FIG. 3 is a somewhat fragmentary side elevational view of the engine taken along arrow 3 in FIG. 1 showing the subject valve control device for one of the two intake valves in an activating operative position for the associated valve lifter; and FIG. 4 is a somewhat fragmentary side elevational view of the engine taken along the arrow 4 in FIG. 2 showing the subject valve control device for one of the two intake valves in an alternate inactivating operative position for the associated valve lifter.

DETAILED DESCRIPTION OF A PREFERRED EMBODIMENT

Figure 1:
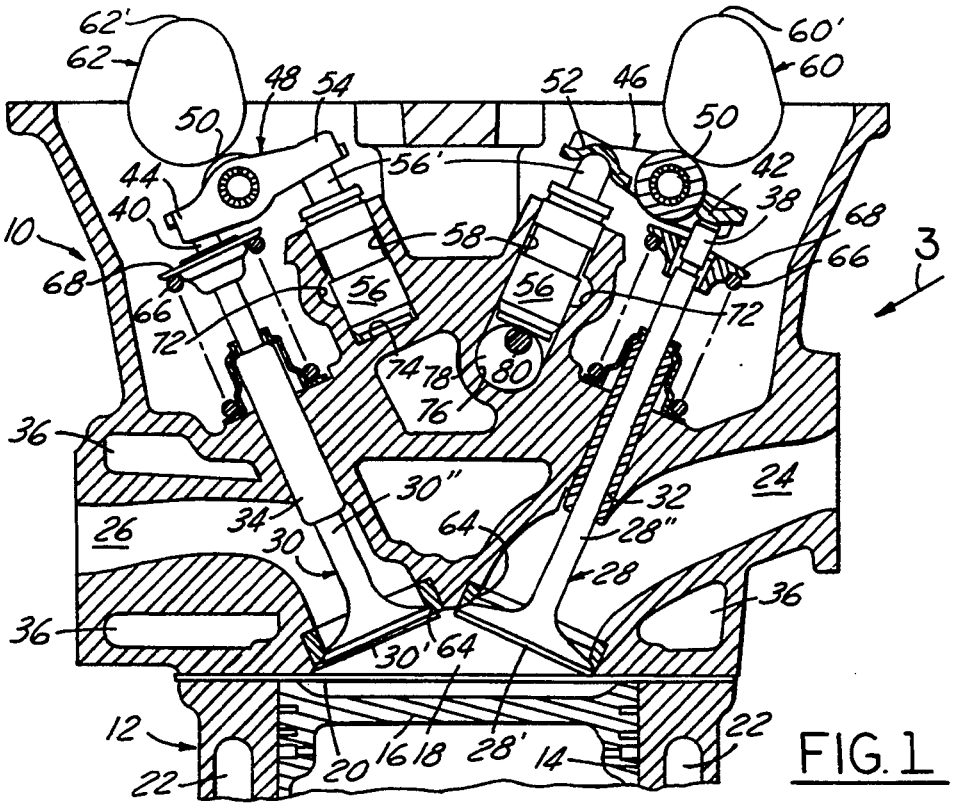
Figure 2:
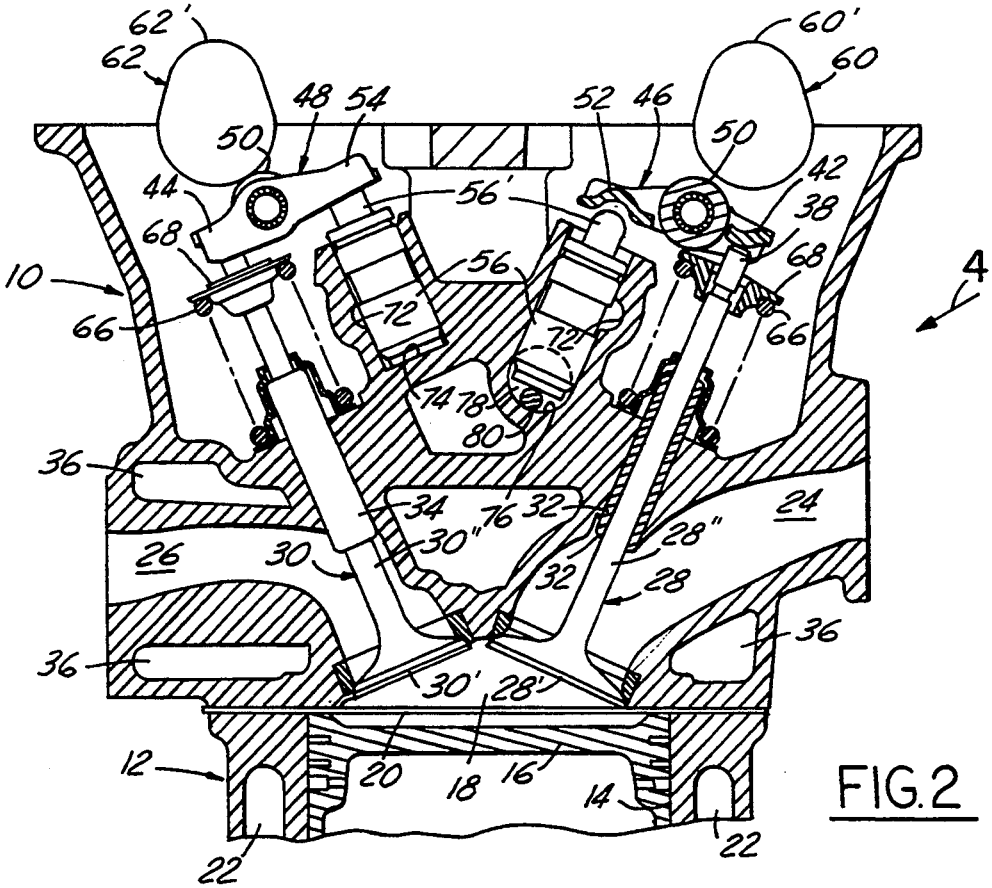

An end sectional view of a cylinder head 10 of an internal combustion engine is illustrated in FIGS. 1 and 2. The cylinder head 10 is attached to an engine block 12 by fasteners (not shown) in a conventional manner known in the engine art. The engine block 12 has at least one cylinder bore 14 in which a reciprocally movable piston 16 is supported. A variable volume combustion chamber 18 is formed in the cylinder bore 14 between the top surface of the piston 16 and the surface of the cylinder head 10. A gasket 20 is located between the head 10 and the block 12. Also, block 12 has coolant filled spaces or jackets 22 for flowing coolant therethrough to cool the block.

The cylinder head 10 defines inlet passages 24 for passing a fluid such as air or an air/fuel mixture to each combustion chamber 18. Cylinder head 10 also has outlet or exhaust gas passages 26 to carry away exhaust gasses from each combustion chamber 18. The flow of air or an air/fuel mixture from the inlet passages 24 into each combustion chamber 18 is controlled by an opening of normally closed inlet valves 28. Likewise, the flow of products of combustion from the combustion chamber 18 to the exhaust passages 26 is controlled by an opening of normally closed exhaust valves 30. Now referring to the longitudinal schematic view in FIG. 3, it can be appreciated that the particular engine applicable to this invention is of the type referred to as a multi-valve engine. As can be understood from the views, the multi-valve engines have more than one inlet passage and valve per combustion chamber. In some multi-valve engines, there are also more than one exhaust passage and valve per combustion chamber.

The engine's inlet and exhaust valves 28, 30 are poppet type valves having an enlarged head portion 28' and 30' and elongated stem portions 28" and 30". A pair of guide members 32, 34 are press fit into bores in cylinder head 10 and have bores axially formed therethrough. The stem portions 38", 30" supportingly extend through the bores in valve guide members 32 and 34 to provide low friction and leak inhibiting support.

Cooling of the cylinder head 10 is achieved in a similar manner as in the engine block 12 by provision of coolant filled passages or jackets 36. The passages 36 are connected to an engine driven coolant pump and a heat exchanger (radiator) as is conventional in the vehicle engine art.

Now referring to the intake and exhaust valves 28 and 30 shown in FIGS. 1 and 2, it can be seen that upper end portions 38, 40 of the valves 28, 30 are engaged by end portions 42, 44 of rocker arms 46, 48, respectively. A needle bearing supported roller 50 is supported near the mid-position of each rocker arm. Opposite ends 52, 54 of rocker arms 46, 48 engage and are supported upon a rounded end portion 56' of a hydraulic lash adjuster 56. The lash adjusters 56 are received in bores 58 of the cylinder head 10. An inlet camshaft 60 and an exhaust camshaft 62 are supported for rotation in the cylinder head 10. Camshafts 60, 62 include a number of axially spaced cam lobe portions 60' and 62' adapted to engage the rollers 50 on the rocker arms. When rotation of a camshaft causes a lobe portion to engage a roller 50, the rocker arm is pivoted about the rounded end of the lash adjuster to depress the associated valve axially in the guide member. This moves the valve's head portion away from seat portions 64 to a more opened position. A coil type spring 66 yieldably resists this opening movement of the valve. The spring 66 is connected to the upper portion of the valve by a retainer assembly 68 in a conventional manner known to the engine art.

The valve lash adjusters 56 are of a hydraulic type which are well known in the engine art. Adjusters are housed in bores 58 in cylinder head 10. Pressurized oil from the engine lubrication system is supplied to the adjusters through a passage forming means 72 in the cylinder head 10. The adjusters 56 take up a limited tolerance necessary in engine valve trains to accommodate expansion caused by temperature change between an engine at ambient temperature and an engine at a normally operating temperature.

The leftward valve adjusters in FIGS. 1 and 2 are associated with and support ends of the rocker arms associated with the exhaust valves 30. These lash adjusters are axially supported in bores 58 by bottom surface 74.

The rightward valve adjusters in FIGS. 1 and 2 are associated with the intake valves and are housed in the bores 58. Bores 58 intersect a longitudinally extending bore 76 which extends longitudinally through the cylinder head 10. The bores 58 and 76 have the same diameter. A shaft 78 is housed for selective rotation in the bore 76. Shaft 78 extends longitudinally through the cylinder head 10 as best understood by reference to FIGS. 3 and 4. Note in FIGS. 3 and 4 that there are two lash adjusters per cylinder 14 or combustion chamber 18. Because of the intersection of bores 58 and bore 76, the inlet associated adjusters 56 are not axially supported by a bottom surface of the bores 58 as is the case with the exhaust associated adjusters. Instead, one of the two inlet related adjusters for each combustion chamber 18 is supported by the outer diameter of the shaft 78. The second of the two inlet related adjusters for each combustion chamber 18 is supported against a reduced diameter eccentrically positioned portion 80 of the shaft 78.

Figure 3:
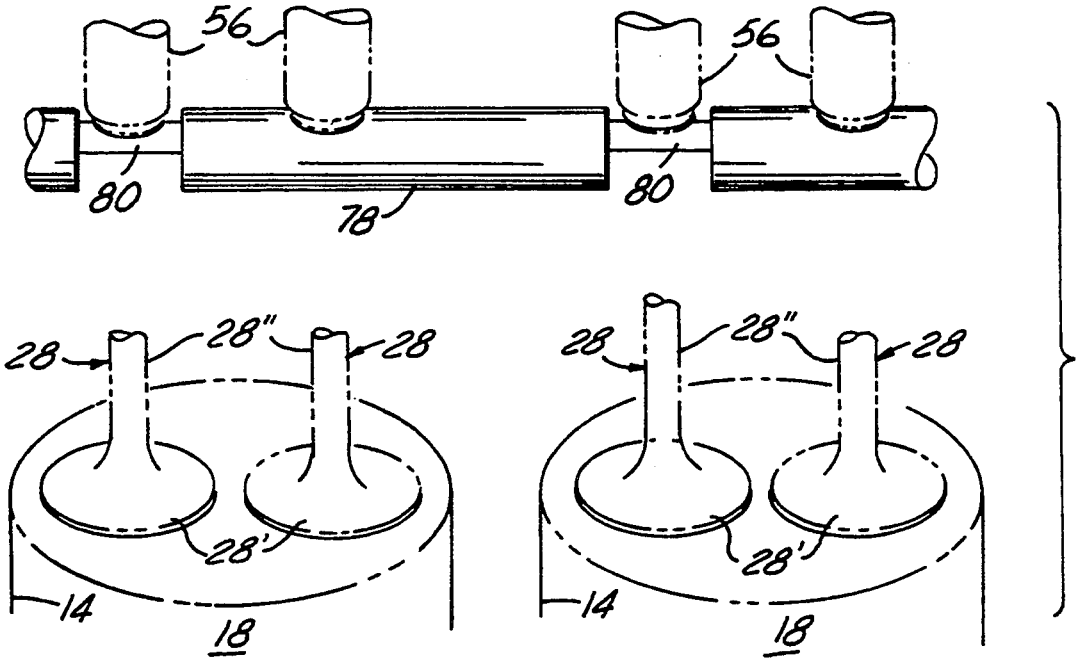

When the shaft 78 is rotated to the position shown in FIGS. 1 and 3, the eccentric portions 80 support the lash adjusters tightly against the inlet camshaft 60. As a lobe portion 60' passes roller 50, the rocker arm 46 is pivoted counterclockwise in FIG. 1 to move inlet valve 28 away from its seated closed position shown in the view toward a more opened position. Thus, in this position of shaft 78, both of the inlet lash adjusters operate similarly to open both of the inlet valves for each combustion chamber.

Figure 4:
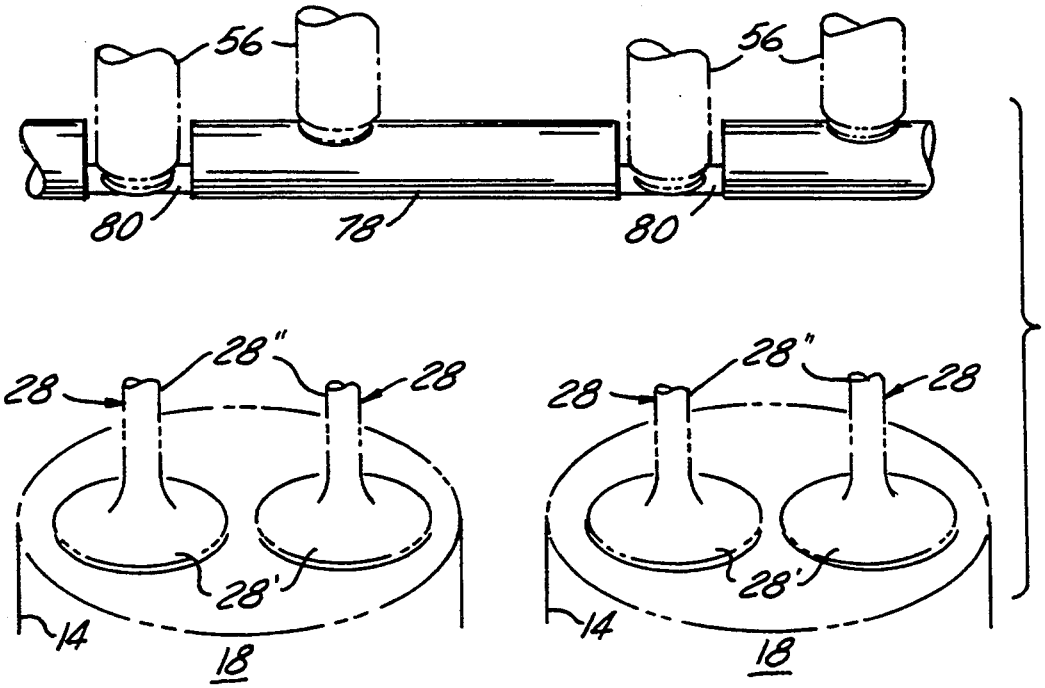

When the shaft 78 is rotated to the position shown in FIGS. 1 and 4, the eccentric portions 80 support the adjacent lash adjusters downward. This allows the associated rocker arm to pivot counterclockwise about the end portion 38 of the inlet valve 28 and space the roller 50 away from the camshaft 60. Now as a lobe portion 60' passes roller 50, the rocker arm 46 is not pivoted counterclockwise as in FIG. 1. Resultantly, the associated inlet valve 28 is not moved from its seated closed position towards a more opened position. Thus, in this position of shaft 78 shown in FIG. 4, only the rightward inlet valve 28 will open in response to passing of the camshaft lobe. The leftward inlet valve will remain closed.

As previously mentioned, the opening of both inlet valves as in FIGS. 1 and 3 is desirable for WOT engine operation and operation under a significant loading condition. The opening of only one inlet valve as in FIGS. 2 and 4 is desirable at idle and under lightly loaded condition.

Although only one embodiment of the invention has been illustrated and described in detail, it should be understood that other embodiments and modifications can be made without falling outside the scope of the invention as is claimed hereinafter.

What is claimed is as follows:

1. A valve regulating mechanism for an internal combustion engine of the type having a combustion chamber, a cylinder head, a pair of intake valves for controlling flow into the combustion chamber, and a camshaft having a lobe portion for each of the intake valves, comprising: a valve lash adjustor supported by the cylinder head for each intake valve; an elongated rocker arm having opposite end portions and a midportion, one of said end portions operatively engaging an intake valve, the other of said end portions supported by one of said lash adjusters, and the midportion being contacted by the camshaft; the cylinder head having a bore extending beneath each lash adjuster; a shaft extending in said bore and capable of being rotated therein; said shaft having an outer cylindrical surface which engages a lash adjuster associated with the first of said pair of intake valves in any rotated position of said shaft; said shaft also having a reduced diameter eccentric portion formed under the other lash adjuster associated with the second of said pair of intake valves, the eccentric portion being radially positioned to define a surface coplanar with said cylindrical surface so that when said shaft is rotated to a first position both of said lash adjusters are supported by the shaft equally whereby the camshaft lobes are effective to operate both of said pair of valves and provide a dual valve mode of operation for the corresponding combustion chamber; said eccentric portion also defining another surface inwardly positioned from said shafts cylindrical surface so that when said shaft is rotated to a second position 180 degrees from the first position the abutting lash adjuster moves radially inward and allows the operatively attached rocker arm to pivot away from the camshaft whereby the corresponding cam lobe is ineffective to operate the associated valve and provide a single valve mode of operation for the corresponding combustion chamber.

2. In an internal combustion engine with a combustion chamber and including a cylinder head with first and second intake valves to control fluid flow into the combustion chamber, an intake valve regulator mechanism to selectively modify the opening characteristics of one of the two intake valves, comprising: an overhead camshaft having a valve operating lobe portion for each intake valve; a valve lash adjustor for each intake valve; a rocker arm with an one end portion operatively engaging an associated intake valve; said rocker arm having a midportion configured for cyclic engagement with a respective camshaft lobe portion, and a second end portion opposite the first which supportingly engages a respective lash adjuster; the cylinder head defining a bore which extends beneath each lash adjuster; a rotatable shaft in said bore with an outer cylindrical surface abuttingly engaging one of said lash adjusters; said shaft also having a reduced diameter eccentric portion with a surface thereof coplanar with said cylindrical surface and so positioned to support the other of said two lash adjusters whereby when said shaft is rotated into a first angular position said coplanar surfaces support both lash adjusters so that the rocker arms are positioned relative to the camshaft so that passing of the lobes thereby pivot said rocker arms about the lash adjuster supports thus operating said valves and when said shaft is rotated into a second angular position 180 degrees from the first position the resultant radial shift of said eccentric portion moves the second of the lash adjusters away from said camshaft so that said rocker arm is not operatively contacted by a passing camshaft lobe thus deactivating the associated intake valve.

3. The intake valve regulator mechanism set forth in claim 2 in which the engine and cylinder head have more than one combustion chambers, each combustion chamber provided with a pair of intake valves, and said bore in said cylinder head and said shaft extend across the combustion chambers.

4. The intake valve regulator mechanism set forth in claim 2 in which the lash adjusters are supported within apertures formed in the cylinder head, the apertures intersecting the bore through which the shaft extends and the bore being of sufficient dimension so as to permit a lash adjuster to move in the shafts radial direction with said eccentric portion.

5. The intake valve regulator mechanism set forth in claim 2 in which rotation of said shaft to a position between said first and second positions is effective to withdraw the associated lash adjuster so as to reduce the opening extent of the associated valve.

6. An internal combustion engine having a block defining at least one combustion chamber, a cylinder head operatively attached to said engine block to enclose said combustion chamber, each combustion chamber having first and second intake valves to control fluid flow into the associated combustion chamber, a rotatable overhead camshaft having a lobe portion for each intake valve and adapted to normally actuate said intake valve into an open position as said camshaft is rotated, a lash adjuster device for each intake valve, the cylinder head defining an aperture for each lash adjuster, a rocker arm with first and second ends and a midportion, the first rocker arm end engaging the end of a respective intake valve, the second rocker arm end being supportingly engaged by a respective lash adjuster, the rocker arm midportion being normally engaged by the lobe portion of said camshaft, an intake valve regulating mechanism for selectively modifying the valve opening characteristics of one of the pair of intake valves for each combustion chamber, the cylinder head defining a bore which extends beneath each lash adjuster and interconnects with said support apertures for said lash adjusters, a shaft rotatably supported in said bore and having an outer cylindrical surface abutting one of said pair of lash adjusters thereby supporting said one lash adjuster radially relative to said shaft; said shaft also having a reduced diameter eccentric portion defining a surface coplanar with said cylindrical surface of said shaft thereby supporting said second of said pair of lash adjusters radially equal to the first lash adjuster when the shaft is rotated to a first operative position thereby providing a dual valve mode of operation, the eccentric portion having other surfaces located radially inwardly from the shaft's outer cylindrical surface thereby supporting said second lash adjuster radially inward from said outer cylindrical surface and away from said camshaft lobe portions as the shaft is rotated from said first operative position thereby reducing the effectiveness of said camshaft lobe in opening the associated intake valve.

7. The intake valve regulator mechanism set forth in claim 6 in which the engine and cylinder head have more than one combustion chambers, and said bore in said cylinder head and said shaft extend across the combustion chambers.

8. The intake valve regulator mechanism set forth in claim 6 in which the lash adjusters are supported within apertures formed in the cylinder head, the apertures intersecting the bore through which the shaft extends and the bore being of sufficient dimension so as to permit a lash adjuster to move in the shafts radial direction with said eccentric portion.

9. The intake valve regulator mechanism set forth in claim 6 in which rotation of said shaft to a position between said first and second positions is effective to withdraw the associated lash adjuster so as to reduce the opening extent of the associated valve.

* * * * *